US005144933A

United States Patent [19]

Nakaniwa

[11] Patent Number: 5,144,933

[45] Date of Patent: Sep. 8, 1992

[54] WALL FLOW LEARNING METHOD AND DEVICE FOR FUEL SUPPLY CONTROL SYSTEM OF INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 656,842

[22] Filed: Feb. 19, 1991

[30] Foreign Application Priority Data

Feb. 19, 1990 [JP] Japan ..... 2-37908

[51] Int. Cl.[5] ..... F02D 41/14

[52] U.S. Cl. ..... 123/675

[58] Field of Search ..... 123/489, 480, 492, 493, 123/486

[56] References Cited

U.S. PATENT DOCUMENTS 4,667,640 5/1987 Sekozawa et al. ..... 123/480
4,905,653 3/1990 Manaka et al. ..... 123/489
4,919,094 4/1990 Manaka et al. ..... 123/493
4,939,658 7/1990 Sekozawa et al. ..... 123/489
5,023,795 6/1991 Matsumura et al. ..... 123/480

FOREIGN PATENT DOCUMENTS 61-268834 11/1986 Japan ..... 123/489
2-61346 3/1990 Japan .

*Primary Examiner*—Andrew M. Dolinar
*Attorney, Agent, or Firm*—Foley & Lardner

[57] ABSTRACT

In a steady operating condition of an engine, the fuel supply quantity is changed compulsorily and step-by-step, and in compliance with changing conditions of the fuel quantity sucked into cylinders after such correction of the fuel supply quantity, a fuel adhesion ratio and an evaporation ratio as the decisive parameters for a wall flow quantity of fuel are learned separately in each operational region, and using the learned results the fuel supply quantity in transitional operation is corrected.

8 Claims, 7 Drawing Sheets

WALL FLOW LEARNING METHOD AND DEVICE FOR FUEL SUPPLY CONTROL SYSTEM OF INTERNAL COMBUSTION ENGINE

BACKGROUND OF THE INVENTION

1. Field of the Invention

The present invention relates to a fuel supply control system of an internal combustion engine for automobiles, more particularly, to a device which is so designed as to calculate fuel supply quantity based on different operating conditions of the engine and to actuate fuel injectors in accordance with the fuel supply quantity.

2. Related Art of the Invention

For use in the fuel supply control system of an internal combustion engine, traditional devices described below are widely known.

In these devices, intake air quantity Q, or intake air pressure PB and engine speed N are detected as engine parameters which relate to the air quantity sucked into cylinders, and based on these parameters the basic fuel injection quantity Tp is computed.

On the other hand, a miscellaneous correcting coefficient COEF based on operating conditions of the engine including engine temperature indicated mainly by the coolant temperature Tw, the air-fuel ratio feedback correction coefficient LMD based on the air-fuel ratio of the intake air mixture which is calculated through the detection of the $O_2$ concentration of exhaust emission, and the voltage correcting quantity Ts to correct the change in the effective opening time of fuel injectors caused by the battery voltage, are respectively utilized.

The basic fuel injection quantity is corrected by the miscellaneous correcting coefficient COEF, the air-fuel ratio feedback correction coefficient LMD, and the voltage correcting value Ts described above, and the result is set as the final fuel injection quantity Ti ($\leftarrow Tp \times COEF \times LMD + Ts$).

In this way, a proper quantity of fuel corresponding to the quantity required by the engine may be supplied by sending to a fuel injector, driving pulse signals with a width equivalent to the final fuel injection quantity Ti, synchronized to the engine revolutions.

The fuel supply quantity Ti is determined, however, to match the engine to provide a steady operating condition. Under these circumstances; the fuel quantity which merges into the wall flow (the fuel adhering to the wall surface of the intake path) and the quantity which is uplifted into cylinders from the existing wall flow turn out to be the same, and an equilibrium state of the wall flow, in which the total quantity of the wall flow would not change, is maintained. Therefore, at the time of acceleration when the wall flow quantity increases, for example, the fuel supply quantity becomes insufficient, thus leading to a leaner air-fuel ration and, as a matter of course, to poorer acceleration performance.

In other words, in a steady operating condition, out of the fuel supplied, the fuel which adheres to the wall surface of an intake path, merging into the wall flow and not supplied directly into the cylinder, and the fuel which evaporates from the wall flow and is sucked into the cylinder, are equally balanced, thus maintaining the wall flow quantity at a certain level corresponding to the engine load, therefore, only by supplying a constant quantity of fuel, it is possible to keep the air-fuel ratio at the target level.

When the engine load is high, however, an equilibrium state is achieved with the greater wall flow quantity, so if the engine is accelerated for example, the fuel newly supplied is used up to supplement this wall flow increase, and the fuel quantity sucked into the cylinders decreases. The equilibrium state recovers again when the wall flow quantity becomes appropriate to the next steady operating condition, so during this transitional operation, the air-fuel ration becomes leaner.

Consequently it is necessary to correct the fuel supply quantity in accordance with changes in the wall flow quantity in order to improve the controllability of the air-fuel ration in transitional operation. However, if there were a change in standing conditions such as an intake valve deposit increase, or a change in fuel properties due to a change in alcohol density in the case of an engine supplied with fuel mixed with alcohol, the initial setting of the wall flow correction would be inappropriate and the controllability of the air-fuel ratio in a transitional condition would deteriorate.

In order to solve the above mentioned problems, the inventor has previously proposed a fuel supply control system which enables learning control of a fuel correcting quantity in transitional operation. (Unexamined Japanese Patent Publication (Kokai) No. 2-61346)

In the conventional transitional learning system, however, air-fuel ratio errors in a transitional condition including various factors such as an air-fuel ratio control error due to the detection response delay of assorted sensors and a change in the required quantity of fuel between the final setting time of the fuel supply quantity and the opening time of intake valves, have been learned instead of the wall flow. Therefore, to learn a fuel correcting quantity in compliance with changes in the wall flow quantity with a high degree of precision, or to grasp the changing condition of the wall flow, has been difficult or impossible.

SUMMARY OF THE INVENTION

The purpose of the present invention is, taking the problems described above into account, to enable learning parameters such as an adhesion ratio and an evaporation ratio which determine the wall flow quantity, in order to detect the momentarily changing condition of the wall flow regardless of a change in standing properties like a valve deposit increase or a change in fuel properties.

It is also the purpose of the invention to enable the detection of changes in a wall flow condition caused by different operating conditions.

Furthermore, the purpose of the invention is to carry out precise fuel correction in correspondence with changes in the wall flow in transitional operation of an engine, based on the results of learning the wall flow condition.

To accomplish the above purposes, in a wall flow learning method and a device for a fuel supply control system of an internal combustion engine in accordance with the present invention, a fuel supply quantity, which has been computed in a steady operating condition of the engine, is corrected in a compulsory step-by-step manner, and based on the changes in the fuel quantity sucked into the cylinders after the correction of the fuel supply quantity, parameters which decide the wall flow quantity of fuel adhering to the intake path wall surface are learned.

In this configuration, if there were no effect of a fuel wall flow when the fuel supply quantity is changed in a compulsory step-by-step manner the fuel quantity sucked into the cylinders should change instantaneously by the corrected quantity of the fuel supply. In fact, however, there exists a fuel wall flow which adheres to the intake path wall surface, and the equilibrium quantity of such a fuel wall flow differs between before and after the correction of the fuel supply quantity, therefore, even if the fuel supply quantity is changed step-by-step as described above, the fuel quantity sucked into the cylinders is able to change only with a delay. This characteristic of change in the fuel quantity sucked into the cylinders can be used to indirectly indicate changes in a fuel wall flow condition.

Accordingly, it is possible to learn parameters which decide the wall flow quantity by observing changes in the fuel quantity sucked into the cylinders after the compulsory fuel correction in steady operation.

After having learned parameters which decide the fuel wall flow quantity adhering to the intake path wall surface, it is preferable to newly store the learned results separately in each partition of operational regions based on operating conditions.

By storing the learned results separately in operational regions in this way, wall flow conditions which differ in each operating condition can be learned independently from each other so learning precision will be improved.

The change in the fuel quantity sucked into the cylinders can also be predicted based on the air-fuel ratio which is detected through component concentration of exhaust emission from the engine.

On the other hand, if an air-fuel ratio feedback correction coefficient for adjusting the quantity of fuel to be fed is set up to have the air-fuel ratio detected through the component concentration of the engine exhaust emission approach the target air-fuel ratio, it is possible to forecast the change in the fuel quantity sucked into the cylinders on the basis of the fuel supply quantity corrected by the inverse number of the air-fuel ratio feedback correction coefficient.

More precisely, whenever feedback correction takes place, the air fuel ratio is corrected to the target air-fuel ratio even though fuel correction had been carried out in order to change the air-fuel ratio in a compulsory manner. Therefore it is impossible, based on the air-fuel ratio, to forecast the fuel quantity sucked into the cylinders after the supply quantity has been in a compulsory manner corrected. On the contrary, the fuel supply quantity which is corrected by the inverse number of the air-fuel ratio feedback correcting coefficient indicates the intake fuel quantity without feedback correction, so it is possible to predict the change in the intake fuel quantity based on the results of such an inverse correction.

As the parameters which decide a fuel wall flow quantity, the adhesion ratio of the supplied fuel to the intake path wall surface and the evaporation ratio from the fuel wall flow adhering to the wall surface can be selected. In other words, the adhesion ratio is the proportion of the supplied fuel which is used for wall flow which evaporates and is sucked into the cylinders.

Now it is possible to construct the device so that a fuel correcting quantity which corresponds to a change in a fuel wall flow quantity in transitional operation of the engine may be determined based on the learned parameters which decide the fuel wall flow quantity adhering to the intake path wall surface, and so that the fuel supply quantity may be corrected based on this fuel correcting quantity in transitional operation.

If decisive parameters of a wall flow quantity are learned, it is possible to properly set a fuel correcting quantity for the correction of air-fuel ratio slippage due to a change in the wall flow quantity, and to improve the controllability of the air-fuel ratio in transitional operation.

Other purposes and features of the present invention will become apparent from the following description of embodiments in conjunction with the accompanying drawings.

PREFERRED EMBODIMENT

Figure 1:
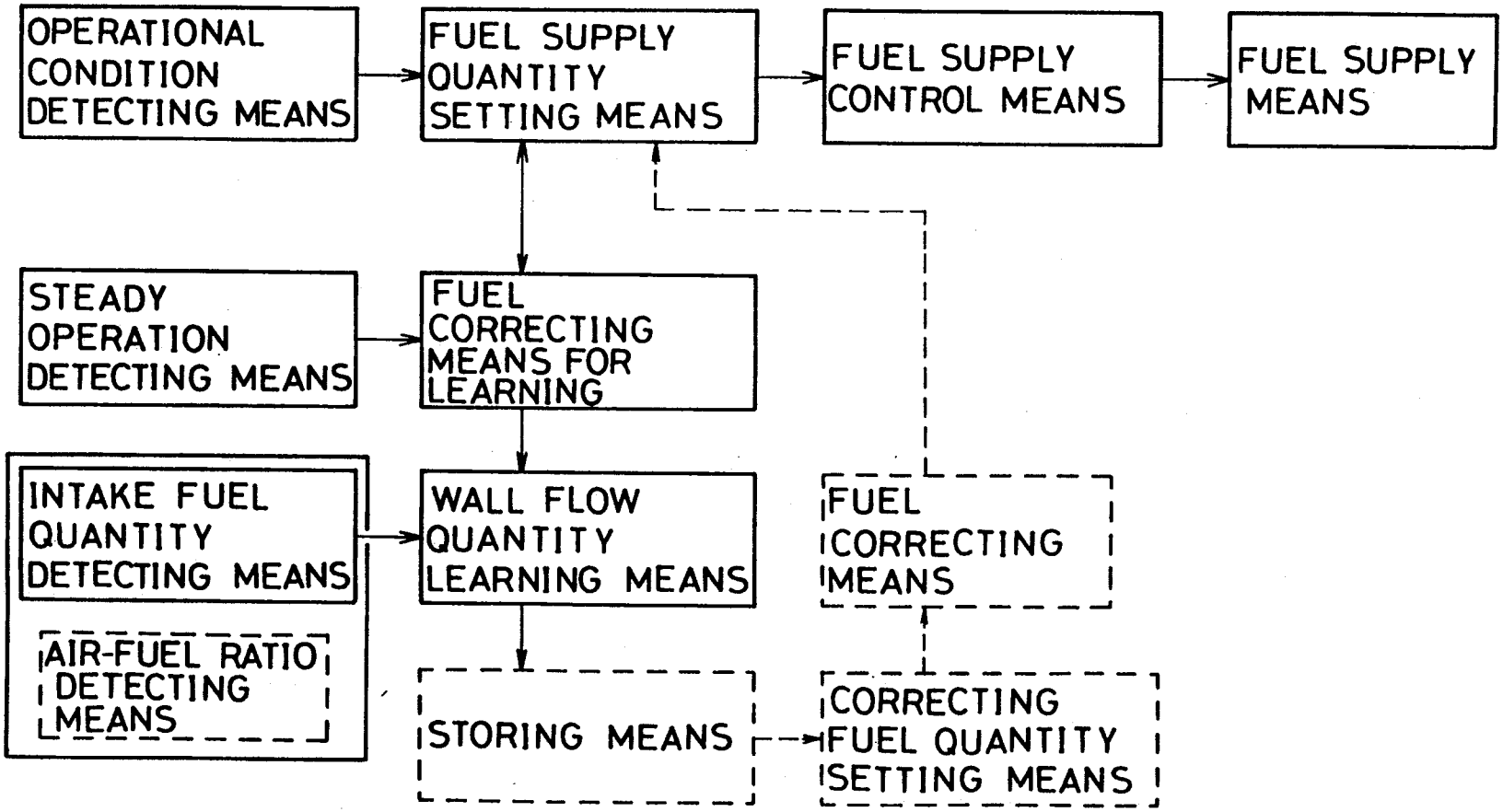
FIGS. 1 and 2 are block diagrams showing the basic configuration of a wall flow learning device for a fuel supply control system of an internal combustion engine in accordance with the present invention.
Figure 2:
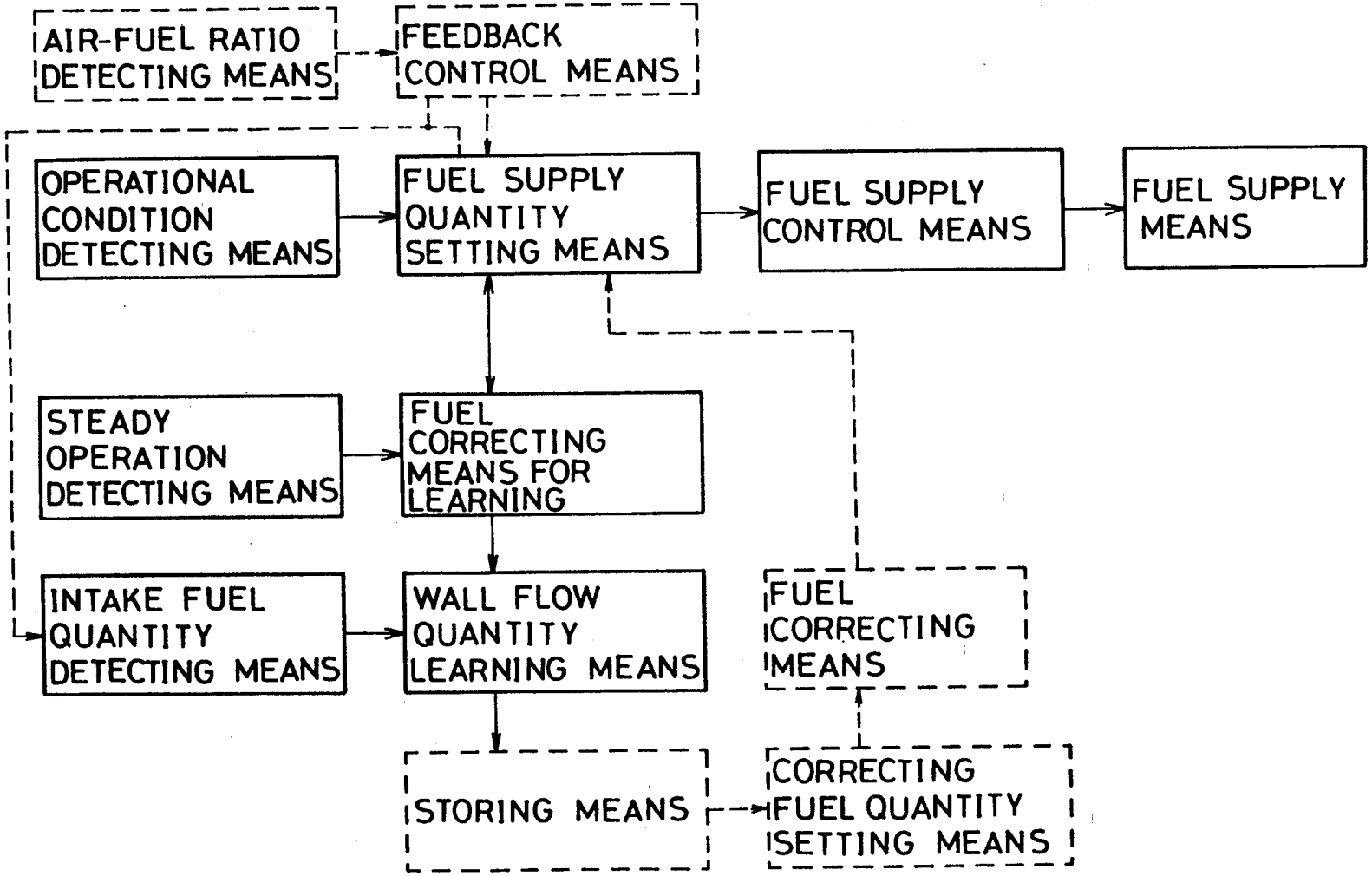

The basic configuration of a wall flow learning device for a fuel supply control system of an internal combustion engine in accordance with the present invention described above is as shown in FIGS. 1 and 2. Some embodiments of the wall flow learning device and the wall flow learning method for a fuel supply control system of an internal combustion engine are shown in FIGS. 3 to 8.

Figure 3:
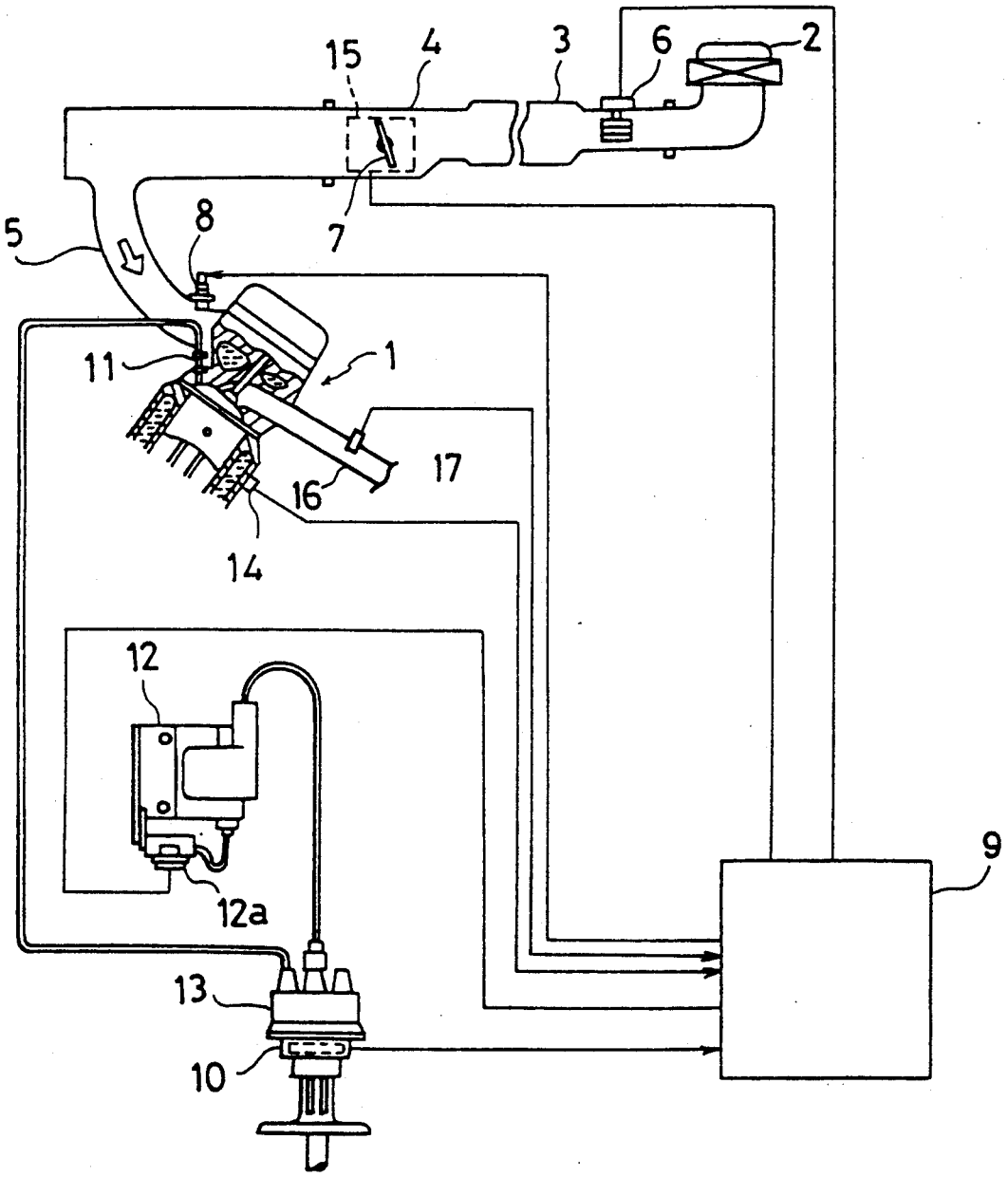
FIG. 3 is a diagram showing the system configuration of an embodiment of the present invention.

In FIG. 3 which shows the system configuration of an embodiment, air is sucked into an internal combustion engine 1 via an air cleaners 2, an air intake duct 3, a throttle chamber 4 and an intake manifold 5.

An air flow meter 6 is provided with the air intake duct 3 to detect the intake air flow rate Q. A throttle valve 7 which interlocks with an not-illustrated acceleration pedal (not illustrated) is provided within the throttle chamber 4 for the control of intake air flow rate Q. A fuel injector 8 as a fuel supplying unit is provided for each cylinder of the intake manifold 5 to inject fuel, which is compressed and fed by a fuel pump (not illustrated) and with its pressure regulated to a specified level by a pressure regulator, into the intake manifold 5.

The fuel injection quantity (fuel supply quantity) at the fuel injector 8 is controlled by a control unit 9 comprising a microcomputer in the following way;

First, using the variables of the intake air flow rate Q detected by the air flow meter 6 and the engine speed N calculated based on the signal from a crank angle sensor 10 built in a distributor 13, a basic fuel injection quantity $Tp=K\times Q/N$ (K: constant) is computed. Next, by correcting this basic fuel injection quantity Tp in compliance with different operating conditions, a final fuel injection quantity Ti is computed. Then, drive pulse signals whose width corresponds to this final fuel injection quantity Ti are, synchronized to the engine revolutions, sent to the fuel injector 8, so that the required quantity of fuel may be injected into the engine 1. Accordingly, the means to detect operational conditions in the present invention are the air flow meter 6, the crank angle sensor 10, and so on.

Also, a spark plug 11 is provided for each cylinder of the engine 1. High voltage generated by an ignition coil 12 and supplied in order via the distributor 13 to the plugs makes them spark to ignite an air-fuel mixture for combustion. The high voltage generating timing of the ignition coil 12 is herein controlled via an attached power transistor 12*a*.

The throttle valve 7 is provided with a throttle sensor 15, having a potentiometer which detects a valve opening TVO. As described later, when the valve opening TVO detected by the throttle sensor 15 is approximately constant, the engine 1 is considered to be in a steady operating condition, so in the present embodiment, the throttle sensor 15 corresponds to the means to detect steady operation.

In addition, the crank angle sensor 10 is so constructed as to output a reference angle signal REF at every 180° which serves as a criterion for controlling the ignition and fuel supply in a 4-cylinder engine, as well as a unit angle signal POS at every unit angle.

Furthermore, an $O_2$ sensor 17 corresponding to the means to detect an air-fuel ratio is provided with an exhaust emission path 16 of the engine 1. Whether the air-fuel mixture sucked into the engine is rich or lean with regard to the ideal air-fuel ratio (target air-fuel ratio) may be determined by comparing the detection signal sent from $O_2$ sensor 17 according to $O_2$ concentration in the exhaust emission, with the reference level corresponding to the ideal air-fuel ratio. Since the $O_2$ concentration in the exhaust emission has a characteristic of dramatically changing on the borderline of the ideal air-fuel ratio, said $O_2$ sensor 17 can detect whether the $O_2$ concentration in the exhaust emissions is high or low in an on-off control manner, or whether the actual air-fuel ratio is rich or lean compared to the ideal air-fuel ratio. The control unit 9 also performs the function of feedback correction of a fuel supply quantity so that the actual air-fuel ratio may approach the ideal air-fuel ratio based upon the rich/lean condition detected by the $O_2$ sensor 17.

Now, with reference to the flow charts in FIGS. 4 to 6, the supply control including wall flow learning in accordance with the present invention is explained in the following description.

Figure 4:
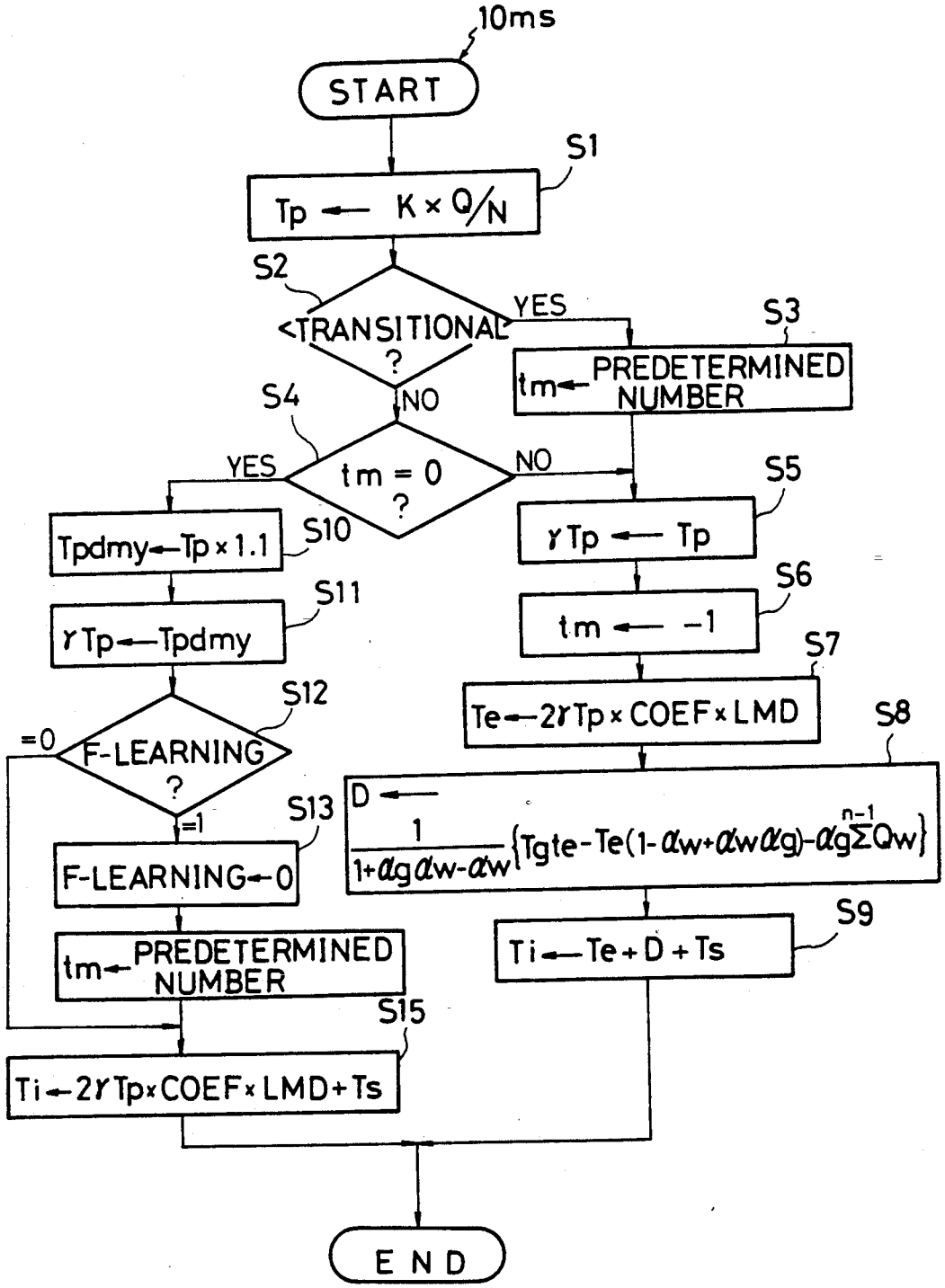
FIGS. 4 to 6 are flow charts showing the fuel control process in each embodiment.
Figure 5:
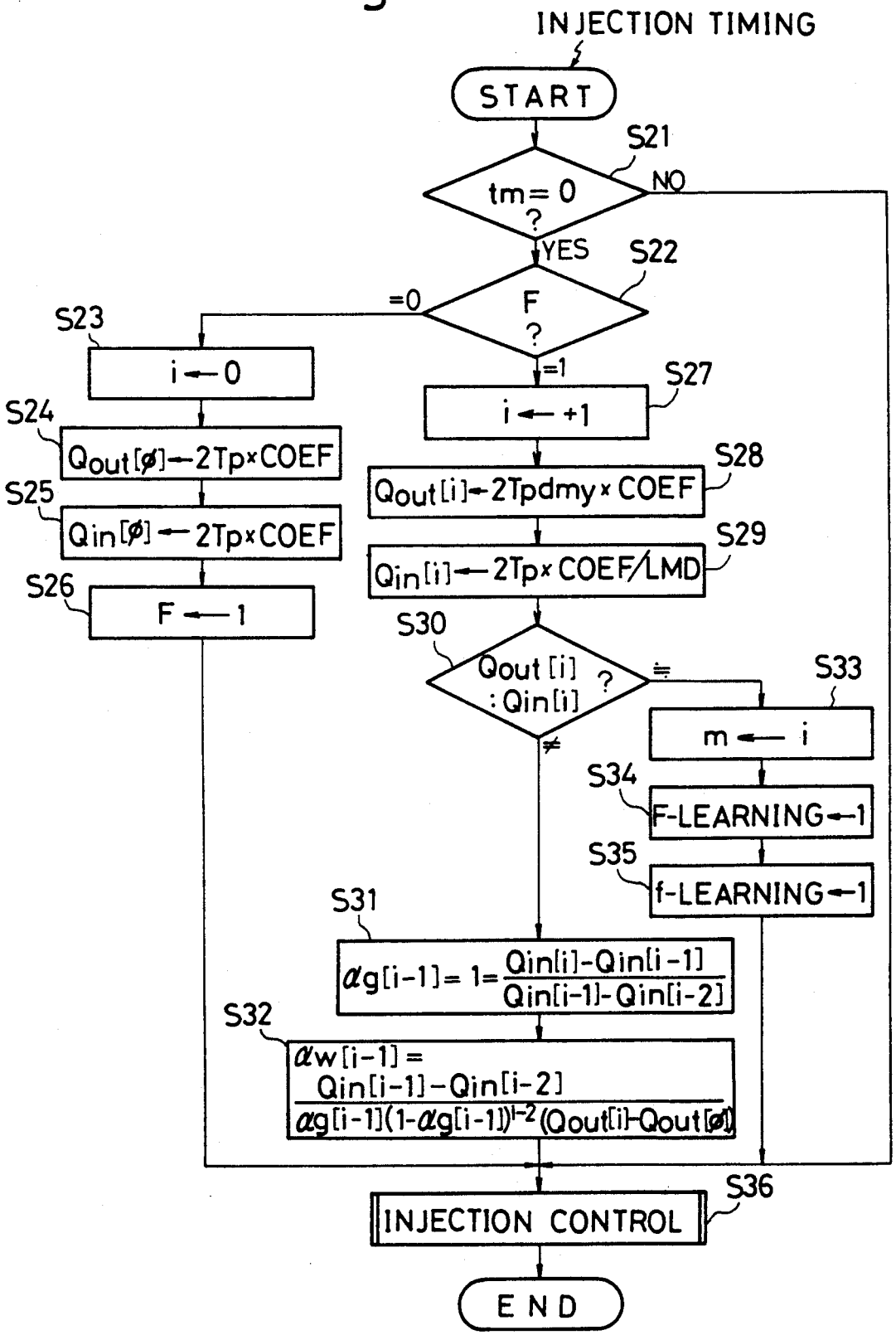
Figure 6:
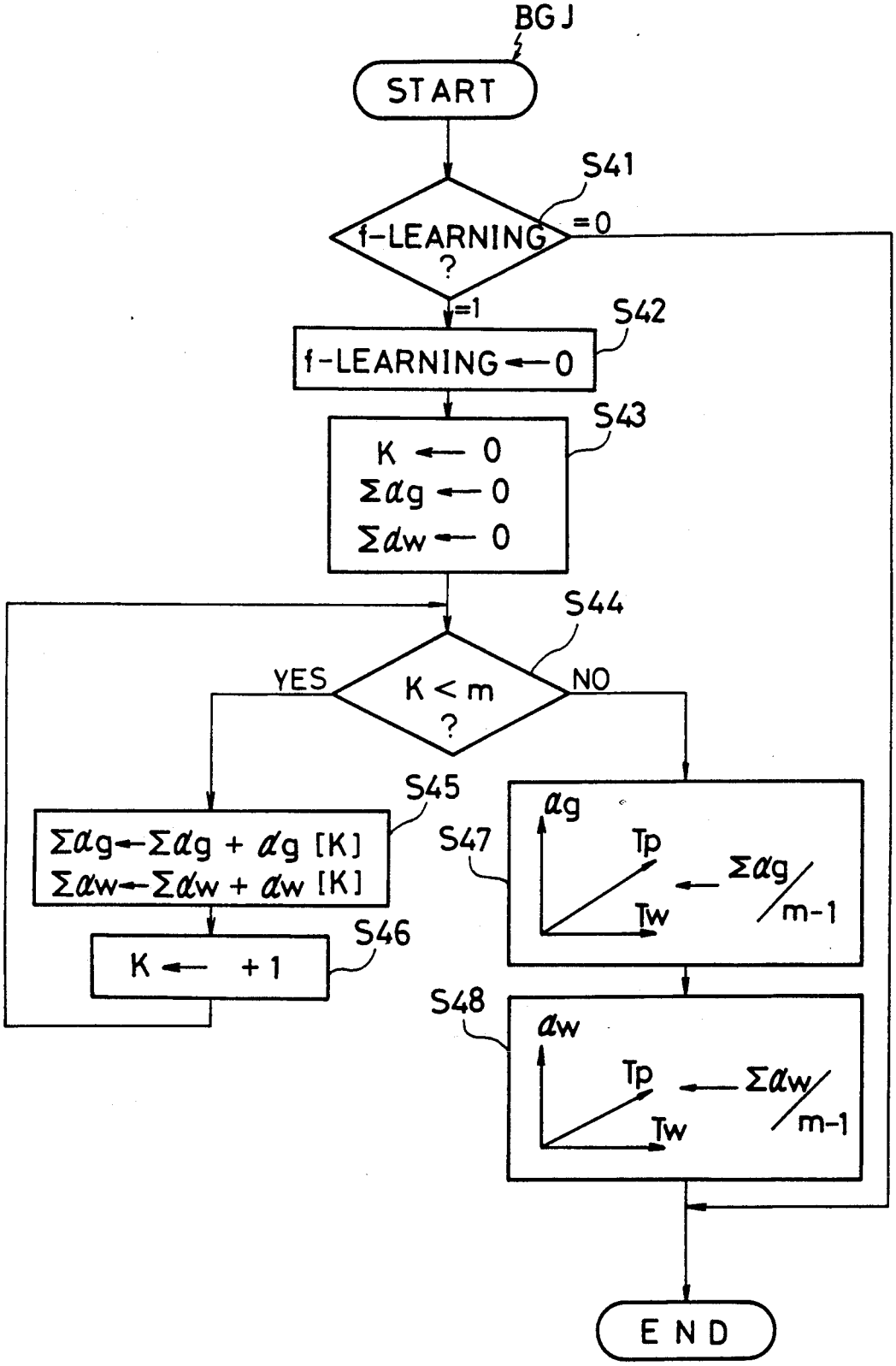
Figure 7:
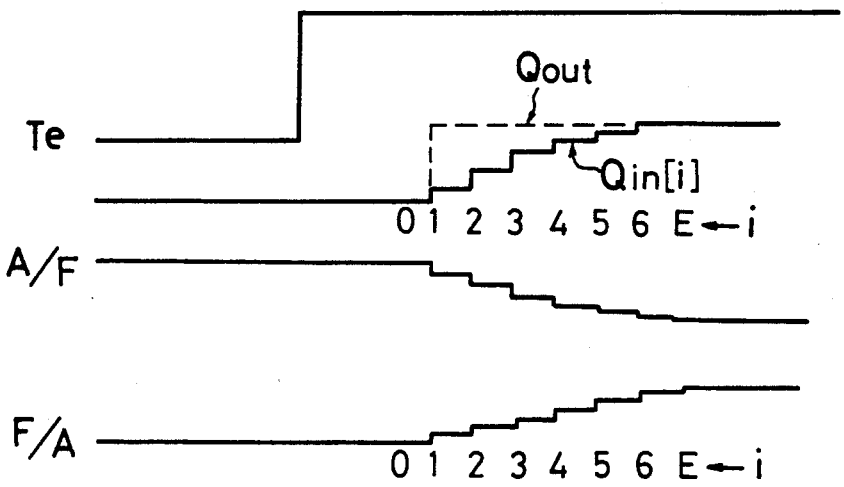
FIGS. 7 and 8 are time charts explaining the control characteristics of the same embodiments as above.
Figure 8:
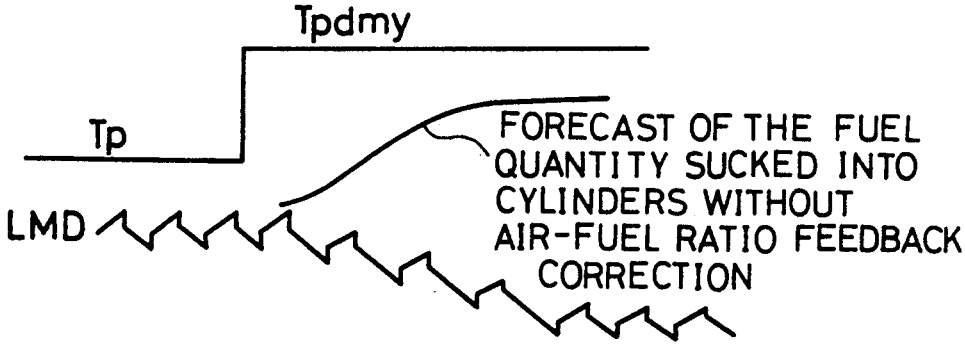

In the present invention, various functional units such as a fuel supply quantity setting unit, a fuel supply control unit, a fuel supply quantity correcting unit, a feedback control unit, a fuel correcting means for learning, a wall flow quantity learning unit, a fuel correcting unit, a fuel correcting quantity setting unit, and an sucked fuel quantity detecting unit are realized by software as shown in the flow charts of FIGS. 4 to 6. Also, the storage unit can be embodied by a RAM having a backup function in a microcomputer built in the control unit 9.

The program shown in the flow chart of FIG. 4 is to be executed at predetermined brief intervals (for example, 10 ms). First, in step 1 (referred to as S1 in the figure, the same abbreviations apply hereinafter), on the basis of the intake air flow rate Q detected by the air flow meter 6 and the engine speed N calculated either by measuring the cycle of the reference angle signals REF from the crank angle sensor 10, or by counting the input numbers of the unit angle signals POS within a specified time period, a basic fuel injection quantity Tp ($\leftarrow K \times Q/N$; K is constant) corresponding to the air quantity sucked into the engine 1 is computed.

Next in step 2, in accordance with the changing rate of the throttle valve 7 opening TVO detected by the throttle sensor 15 a for example, a judgement is made whether the engine 1 is in a transitional or in a constant operation condition.

When the valve opening TVO detected by the throttle sensor 15 is changing and the engine 1 is judged to be in transitional operation, the program proceeds to step 3, where a predetermined number is set in a timer tm to measure the elapsed time after the operational condition has changed from transitional to a steady condition in the manner described later.

On the other hand, when the valve opening TVO is approximately constant and the engine 1 is judged to be in a steady operating condition in step 2, the program proceeds to step 4, where a judgement is made whether the timer tm is set to 0 or not.

When the timer tm setting is judged not to be 0 in step 4, then in step 5 the basic fuel injection quantity Tp calculated in step 1 is set as a final basic fuel injection quantity $\gamma Tp$, and in the following step 6, 1 is subtracted from the timer tm reading. In other words, during transitional operation as well as during the count down of the timer tm from the predetermined number to 0 after the operational condition has changed from transitional to steady, by virtue of the fact that the timer tm setting was judged not to be 0 in step 4, the basic fuel injection quantity Tp based upon the intake air flow rate Q and the engine speed N may be used as a final basic fuel quantity $\gamma Tp$.

After substracting 1 from the timer tm reading in step 6, an effective fuel injection quantity Te excluding the wall flow correcting quantity D described later is determined in step 7 according to the following formula:

$$Te \leftarrow 2\gamma Tp \times COEF \times LMD$$

In this operational expression, COEF indicates miscellaneous correction coefficients including ones for a rise in coolant temperature and for a rise after engine start based on the coolant temperature Tw. LMD is an air-fuel ratio feedback correction coefficient used for the feedback correction of the basic fuel injection quantity $\gamma Tp$, to the end that the actual air-fuel ratio may approach the ideal air-fuel ratio according to the judgement on whether the air-fuel ratio of the mixture air sucked into the engine, which is detected by the $O_2$ sensor 17, is rich or lean against the ideal air-fuel ratio (target air-fuel ratio). LMD is controlled proportionally and integrally for example, with 1 as the reference value. That is to say, when the air-fuel ratio is rich (lean), it is decreased (increased) initially by a specified proportional portion P, then decreased (increased) gradually by a specified integral portion 1, and when the rich (lean) condition doesn't exist any longer and the air-fuel ratio is inverted, the proportional control process is carried out again, and thus the actual air-fuel ratio is repeatedly inverted around the ideal air-fuel ratio.

In the following step 8, a wall flow correcting fuel quantity D for the correction of changes in a wall flow quantity in transitional operation of the engine 1 is calculated according to the formula below:

$$D \leftarrow \frac{\left\{ Tgte - Te(1 - \alpha w + \alpha w \cdot \alpha g) - \alpha g \sum^{n-1} Qw \right\}}{1 + \alpha g \cdot \alpha w - \alpha w}$$

In this operational expression, $\alpha w$ is the ratio of the fuel adhering to the wall surface of the intake manifold 5 which becomes a wall flow, to the total quantity of the fuel injected by the fuel injector 8, and $\alpha g$ is the ratio of the fuel evaporating from the wall flow and supplied into the cylinders, to the wall flow, both of which can be retrieved for use out of data stored respectively in maps with the basic fuel injection quantity Tp and the coolant temperature Tw as parameters in the manner described later. Also, $$\sum^{n-1} Qw$$

is the latest value of the total quantity of fuel which adheres to the wall surface of the intake manifold 5.

Here Te is the value found by excluding the wall flow correcting fuel quantity D from the effective injection quantity Te ($\leftarrow 2 \times \gamma Tp \times COEF \times Imd + D$), which is gained by subtracting the battery voltage correcting quantity Ts described later from the fuel injection quantity Ti ($\leftarrow 2 \times \gamma Tp \times COEF \times LMD + D + Ts$), and Tgte is the fuel quantity sucked into the cylinders. If the fuel quantity is considered not to include the fuel quantity corresponding to the target air-fuel ratio or the wall flow correcting fuel quantity D, the following formula applies:

$$Te = Tgte = 2 \times \gamma Tp \times COEF \times LMD$$

Provided that Te equals Tgte, the above mentioned operational expression of D is simplified as follows:

$$D \leftarrow \frac{\left\{ \alpha w \cdot Te - \alpha w \cdot \alpha g \cdot Te - \alpha g \sum^{n-1} Qw \right\}}{1 + \alpha g \cdot \alpha w - \alpha w}$$

How this operational expression of the wall flow correcting fuel quantity D is derived is described later in detail, however, the wall flow correcting quantity D is indispensable for the following reasons:

In steady operation, the fuel quantity which becomes a new wall flow is equally balanced with the fuel which evaporates from the wall flow and is supplied into the cylinders, keeping wall flow rate in a state of equilibrium and supplying a fixed quantity of fuel into the cylinders. In this case, the wall flow rate (total quantity of fuel which adheres) is decided generally by the injected quantity, the adhesion ratio $\alpha w$, and the evaporation ratio $\alpha g$. The larger the injected quantity is, the greater the wall flow which gives a balanced state is, therefore, when accelerating for example, it is necessary to increase the wall flow quantity. Nevertheless, since the basic fuel injection quantity Tp cannot comply with this demand, the fuel quantity sucked into the cylinders is obliged to decrease by the quantity used for the increase in the wall flow quantity, and as a matter of course, the air-fuel ratio becomes leaner. In contrast to this, when accelerating and the wall flow quantity decreases, out of the large wall flow quantity before deceleration excessive fuel is sucked into the cylinders to make the air-fuel ratio richer. In order to solve these problems, the fuel supply quantity may be corrected by the exact quantity corresponding to a change in the wall flow quantity in such a way as to supply more fuel in the same quantity as is used for the increase in the wall flow quantity, or, in the case where the wall flow quantity decreases, to decrease injected fuel by the quantity decreased so that the controllability of the air-fuel ratio in transitional operation may be improved:

In addition, the wall flow rate (total quantity of fuel which adheres) Qw in steady operation is calculated according to the following formula, and since Qw equals $$\sum^{n-1} Qw$$

in steady operation, the wall flow correcting fuel quantity D becomes 0:

$$Qw \leftarrow \frac{\alpha w(1 - 4g)}{\alpha w} \cdot Te$$

Also, a wall flow quantity $$\sum^{n} Qw$$

is calculated by adding a newly injected fuel quantity which becomes a wall flow $\alpha w$ (D+Te) to the past total quantity of adhesion $$\sum^{n-1} Qw$$

and at the same time by subtracting the quantity evaporating from the wall flow and sucked into the cylinders $\alpha g\{\Sigma Qw + \alpha w(D+Te)\}$ from $$\sum^{n-1} Qw.$$

Therefore, in transitional operation, the wall flow correcting fuel quantity D is first calculated, then on the basis of this quantity D and the effective fuel injection quantity Te at that time, the wall flow quantity $$\sum^{n} Qw$$

is calculated. When calculating the next correcting quantity D, this data is used as a new past value $$\sum^{n-1} Qw.$$

After the calculation of the wall flow correcting fuel quantity D in the manner described above, next in step 9 the final fuel injection quantity Ti ($\leftarrow Te + D + Ts$) is computed using the effective injection quantity $Te \leftarrow 2 \times \gamma Tp \times COEF \times LMD$ calculated in step 7, the wall flow correcting fuel quantity D calculated in the proceeding step 8, and the voltage correcting quantity Ts for the correction of changes in the effective injection time of the fuel injector 8 caused by battery voltage.

Also, when the timer tm setting is judged 0 in step 4 or when the predetermined time decided by the predetermined number set in the timer tm after the operational condition has changed from transitional to constant has elapsed, the program proceeds to step 10.

In step 10, the basic fuel injection quantity Tp calculated in step 1 is, being multiplied by a predetermined number (1.1 in the present embodiment), corrected to increase step-by-step by the specified rate, and is forced to be more than the quantity corresponding to the intake air quantity, and the resulting quantity is set as Tpdmy.

Next in succeeding step 11, the increasingly corrected basic fuel injection quantity Tpdmy in step 10 is set in the final basic fuel injection quantity $\gamma$Tp, so that the fuel supply may be controlled according to the basic fuel injection quantity Tpdmy.

In the following step 12, judgement is made whether a flag "F-learning", which judges the end of learning the adhesion ratio $\alpha$w and the evaporation ratio $\alpha$g, indicates 0 or 1.

The flag "F-learning" is set to 1 when learning is ended, and when learning is not ended, 0 is indicated. Therefore, if the flag "F-learning" is judged to indicate 1, it means that learning using the basic fuel injection quantity Tpdmy is ended. In this case, in order that the injection might be controlled again based on a normal basic fuel injection quantity Tp, the flag "F-learning" is set to 0 in step 13, while a predetermined number is set in the timer tm in step 14 so that the program may proceed to step 5 from step 4 for the next time.

On the other hand, when the flag "F-learning" is judged to be 0, it means that learning the adhesion ratio $\alpha$w and the evaporation ratio $\alpha$g is underway, so the program jumps over steps 13 and 14 and proceeds to step 15.

In step 15, a final fuel injection quantity Ti ($\leftarrow 2\times\gamma$Tp$\times$COEF$\times$LMD) is computed based on the basic fuel injection quantity Tpdmy acquired in step 10 by increasingly correcting the basic fuel injection quantity Tp by the predetermined rate corresponding to the normal intake air quantity without adding the wall flow correcting fuel quantity D.

In this way, when the predetermined time has elapsed after the transfer from transitional to steady operation, the basic fuel injection quantity Tp at that time is corrected to increase by the predetermined rate, and at the same time learning the adhesion ratio $\alpha$w and the evaporation ratio $\alpha$g is carried out. After learning is ended, the fuel control system based on the normal basic fuel injection quantity Tp is actuated again. The fuel supply control based on the injected fuel quantity Ti and learning the adhesion ratio $\alpha$w and the evaporation ratio $\alpha$g are executed according to the program shown in the flow chart of FIG. 5.

The program shown in the flow chart of FIG. 5 is to be executed after the fuel injection starting time for the fuel injector 8 is detected through the signals from the crank angle sensor 10. First in step 21, judgement is made whether the timer tm, which is set in the flow chart of FIG. 4, indicates 0 or not.

If the timer tm is set to 0, it means that the engine is in a steady operating condition and that the fuel injection quantity Ti is decided based on the basic fuel injection quantity Tpdmy, and the program proceeds to step 22 and further on, where learning the adhesion ratio $\alpha$w and the evaporation ratio $\alpha$g is executed. If the timer tm setting is not 0, the fuel injection quantity Ti is set normally, and the program jumps to step 36, where drive pulse signals with a width corresponding to the fuel injection quantity Ti determined in step 9 in the flow chart of FIG. 4 are sent to the fuel injector 8, which executes fuel injection.

On the other hand, when the timer tm setting is judged 0 in step 21 and the program proceeds to step 22, judgement is made for the flag "F" which indicates whether the judgement that the timer tm setting is 0 is being made for the first time.

When the flag "F" is 0, that means that the judgement that the timer tm is 0 is made for the first time. In this case, the program proceeds to step 23, where 0 is set in i which is used to count the number of learning samples for initialization (see FIG. 7).

In the next step 24, 2Tp$\times$COEF is set as the actual fuel injection quantity Qout[$\phi$] injected by the fuel injector 8, and in step 25, 2Tp$\times$COEF is set again, this time as the fuel quantity sucked into the cylinders Qin[$\phi$]. That is to say, because this is the first time that the timer tm setting is judged 0, and, although the fuel injection quantity Ti is determined based on the basic fuel injection quantity Tpdmy, it has not been injected actually; and the equilibrium state where the fuel injection quantity Ti based on the basic fuel injection quantity Tp before the correction corresponds with the fuel quantity sucked into the cylinders, is regarded as the initial learning state.

In the following step 26, the flag "F" is set to 1, so that when the present program is executed the next time it may proceed from step 22 not to step 23 but to step 27.

At the second injection starting time after the timer tm setting has become 0, and when the program proceeds from step 22 to step 27, the number of learning samples i which have been reset to 0 in step 23 is increased by 1.

In the next step 28, 2$\times$Tpdmy$\times$COEF is set as the actual injection quantity Qout[i], and in succeeding step 29, 2$\times$Tp$\times$COEF/LMD is set as the actual sucked fuel quantity Qin[i] with regard to the 2$\times$Tpdmy$\times$COEF.

In other words, even if the quantity of the basic fuel injection quantity Tp were replaced by Tpdmy and the injected quantity of fuel were increased step-by-step, the fuel quantity sucked into the cylinders would not necessarily synchronize with the change to increase step-by-step the wall flow quantity corresponding to the increase in the injected fuel quantity, and in order to satisfy such a demand to increase the wall flow quantity, most of the injected fuel will adhere to the wall surface to merge into the wall flow. When the wall flow quantity increases up to the injected quantity corresponding to 2$\times$Tpdmy$\times$COEF, an equilibrium state is attained, and the quantity 2$\times$Tpdmy$\times$COEF begins to be sucked into the cylinders. Therefore the fuel quantity sucked into the cylinders changes gradually from 2$\times$Tp$\times$COEF to 2$\times$Tpdmy$\times$COEF.

When the fuel quantity sucked into the cylinders Qin[i] increases gradually from 2$\times$Tp$\times$COEF in this way, the air-fuel ratio becomes richer gradually, and in order to restrain this, the air-fuel ratio feedback correction coefficient LMD is suppressed gradually to a smaller value. Accordingly, a change or an increase in Qin[i] is able to be grasped by such a drift of the air-fuel ratio feedback correction coefficient LMD. That is to say, the inverse number of the air-fuel ratio feedback correction coefficient LMD is regarded as indicating an increase rate, and 2×Tp×COEF/LMD, as indicating Qin[i] (see FIG. 8).

Additionally, in the case of providing a sensor which can detect not whether the air-fuel ratio is rich or lean in relation of the target ratio, but the air-fuel ratio as it is, it may be so constituted as to forecast and set a fuel quantity sucked into the cylinders using the ratio F/A of the fuel quantity F detected by an air-fuel ratio sensor to the air quantity A, instead of the air-fuel ratio feedback correction coefficient LMD.

In the succeeding step 30, a judgement is made whether the fuel injection quantity Qout[i] and the quantity sucked into the cylinders Qin[i] set in steps 28 and 29 are almost the same. When the wall flow quantity increases up to the quantity corresponding to the injected quantity 2×Tpdmy×COEF, Qout[i] is almost in accordance with Qin[i]. Up to this point, however, Qout[i] differs from Qin[i] and the program proceeds to step 31.

In step 31, the evaporation ratio $\alpha g[i-1]$ of the fuel which evaporates from the wall flow is computed according to the following formula:

$$\alpha g[i-1] = 1 - \frac{Qin[i] - Qin[i-1]}{Qin[i-1] - Qin[i-2]}$$

Also in the next step 32, the adhesion ratio $\alpha w[i-1]$ of the injected fuel which adheres to the intake path wall surface and becomes a wall flow is computed according to the following formula:

$$\alpha w[i-1] = \frac{Qin[i-1]Qin[i-2]}{\alpha g[i-1](1-\alpha g[i-1]^{i-2}(Qout[i] - Qout[0])}$$

How these operational expressions to determine the evaporation ratio $\alpha g[i-1]$ and the adhesion ratio $\alpha w[i-1]$ have been drawn is described later.

On the other hand, when the fuel quantity sucked into the cylinders Qin[i] gradually approaches the injected quantity Qout[i], and Qout[i]=Qin[i] is confirmed in step 30, the program proceeds to step 33, where the value i indicating the number of the past learning samples is set to m.

Also in the following step 34, in order to display the end of learning the evaporation ratio $\alpha g$ and the adhesion ratio $\alpha w$, the flag "F" which is judged in step 12 of the flow chart in FIG. 4 is set to 1, and succeedingly in the next step 35, the flag "f-learning" is set to 1 so that it may be determined whether the learning results of the evaporation ratio $\alpha g$ and the adhesion ratio $\alpha w$ are all obtained in the flow chart of FIG. 6 described later.

Next in step 36, the fuel control based on the fuel injection quantity Ti is executed.

The program shown in the flow chart of FIG. 6 is to undergo background processing. First in step 41 a judgement is made on the flag "f-learning" which has been set to 1 at the end of learning in the flow chart of FIG. 5. If the flag "f-learning" is 1, the program proceeds to step 42, where the flag is set to 0, then it proceeds to step 43.

In step 43, not only are integrated values $\Sigma\alpha g$, $\Sigma\alpha w$ of the evaporation ratio $\alpha g$ and the adhesion ratio $\alpha w$ reset to 0 respectively, but also a counter K which is used to count the number of samples in the integrated values $\Sigma\alpha g$ and $\Sigma\alpha w$ is reset to 0.

And in the next step 44, a judgement is made whether the counter K reading is less than the learning sample number m or not, and when K is less than m, the program proceeds to step 45, where $\alpha g[K]$ and $\alpha w[K]$ are integrated in order and the results are set in $\Sigma\alpha g$ and $\Sigma\alpha w$. After that in next step 46, the counter K reading is increased by 1.

That means that evaporation ratio $\alpha g$ and adhesion ratio $\alpha w$ which have been calculated in past learning are totaled respectively to find the sum total. If it is judged in step 44 that K is not less than m and the integration of all results of learning is ended, the program proceeds to step 47.

In step 47, the mean value of the evaporation ratio $\alpha g$ is calculated by dividing the integrated result $\Sigma\alpha g$ in step 45 by the integration number m−1. Using the mean value as updated data corresponding to the existing operating condition in operational regions divided into partitions by the basic fuel injection quantity Tp and the coolant temperature Tw, the map data in the RAM is updated.

In a like manner, in the following step 48 the mean value of the adhesion ratio $\alpha w$ is calculated, and based on the result the map data is renewed.

The map data, where the evaporation ratio $\alpha g$ and the adhesion ratio $\alpha w$ are stored respectively in operational regions classified by the basic fuel injection quantity Tp and the coolant temperature Tw in the manner above described, is used for the calculation of said wall flow correcting fuel quantity D in step 8 of the flow chart in FIG. 4. In this way, even if the evaporation ratio $\alpha g$ and the adhesion ratio $\alpha w$ had been so prestored as to match the initial condition of the engine 1, since the evaporation ratio $\alpha g$ and the adhesion ratio $\alpha w$ are updated with the actual data each time the evaporation ratio $\alpha g$ and the adhesion ratio $\alpha w$ change due to a transitional change or a change in fuel properties, it is possible to precisely perform the fuel correction complying with the wall flow condition determined by the evaporation ratio $\alpha g$ and adhesion ratio $\alpha w$. Furthermore, the learning the evaporation ratio $\alpha g$ and the adhesion ratio $\alpha w$ takes place at the time of steady operation as described above, hence, there is no need to separate factors (e.g. detection delay of sensors) other than a wall flow, which may deteriorate the controllability of the air-fuel ratio in transitional operation, and self-adaptive control can be carried out with precision.

The following is a description how the above quoted expressions of the wall flow correcting fuel quantity D, the evaporation ratio $\alpha g$, and the adhesion ratio $\alpha w$ are formulated.

First, the relationship of the injected quantity Qout and the fuel quantity actually sucked into the cylinders Qin is formulated as follows:

$$Qin = Qout + \alpha g\left(\sum^{n-1} Qw + Qout \cdot \alpha w\right) - Qout \cdot \alpha w \quad (1)$$

Here, Qout×$\alpha w$ is the quantity of the injected fuel which adheres to the wall surface and is not sucked in directly. The fuel corresponding to the quantity which is found by multiplying the total of the quantity lately adhered Qout×$\alpha w$ and the sum total of the past adhesion quantity $$\sum^{n-1} Qw$$

by the evaporation ratio $\alpha g$, evaporates and is sucked into the cylinders.

Now, if the wall flow correcting fuel quantity D is added to the above expression, it becomes as follows.

$$Qin = Qout + \alpha g\left\{\sum^{n-1} Qw + (Qout + D)\alpha w\right\} - (Qout + D)\alpha w + D$$

Now, Qin in this expression, being considered to be the fuel quantity corresponding to the target air-fuel ratio, may be replaced by Tgte, Qout to be replaced by Te, which is gained by subtracting the wall flow correcting fuel quantity D from the effective injection quantity Te gained by subtracting the battery voltage correcting quantity Ts from the injection quantity Ti, and the above expression may be rewritten to find D. In this way, the operational expression to find the wall flow correcting fuel quantity D described above is determined. Now for the calculation of the wall flow correcting fuel quantity D, the following formula may be applied as described above:

$$Te = Tgte = 2 \times Tp \times COEF \times LMD$$

Also in steady operation, since the injected quantity Qout equals the fuel quantity sucked into the cylinders Qin, the sum total of the adhesion quantity $$\sum^{n-1} Qw$$

in the above expression (1) can be replaced with the sum total of the adhesion quantity in constant operation Qw, which may be found in the following formula:

$$Qw = \frac{\alpha w(1 - \alpha g)}{\alpha g} \cdot Te \qquad (2)$$

Furthermore, the sum total of the adhesion quantity in transitional operation $$\sum^{n} Qw$$

equals the value which is gained by subtracting the quantity which evaporates and is sucked into the cylinders from the entire wall flow gained by adding the newly injected fuel quantity which merges into the wall flow to the past sum total of the adhesion quantity $$\sum^{n-1} Qw,$$

so the following formula applies:

$$\sum^{n} Qw = (1 - \alpha g)\left\{\sum^{n-1} Qw + \alpha w(D + Te)\right\} \qquad (3)$$

Also, the difference between the injected quantity Qout and Qin, which occurs when the fuel injection quantity Ti is corrected to change in a compulsory step-by-step manner at the time of steady operation, can be found from the expression (1) as follows:

$$Qout - Qin = Qout \cdot \alpha w(1 - \alpha g) - \alpha g \cdot \sum^{n-1} Qw \qquad (4)$$

Now by substituting the expressions (2) and (3) into (4) to formulate an expression to find the change in the difference between Qout and Qin, Qout(K)−Qin(K), or the difference between Qout and Qin the K-th time after the correction of the basic fuel injection quantity, Tp is found in the formula below:

$$Qout(K) - Qin(K) = Qout(K) \cdot \alpha w(1 - \alpha g) - \alpha g\,(1 - \alpha g)^K \times \left\{\frac{\alpha w}{\alpha g} \cdot Qout(\phi) + \frac{\alpha w}{1 - \alpha g} \cdot Qout(1) + \ldots + \frac{\alpha w}{(1 - \alpha g)^{K-1}} \cdot Qout(K - 1)\right\}$$

Now Qout(K) is fixed to 2×Tpdmy×COEF in a steady operating condition, so it may be replaced with Qout as follows:

$$Qout - Qin(K) = Qout \cdot \alpha w(1 - \alpha g) - \alpha w \cdot \alpha g\,(1 - \alpha g)^K \cdot Qout \times \left\{\frac{1}{\alpha g} \cdot \frac{Qout(\phi)}{Qout} + \frac{1}{1 - \alpha g} + \ldots + \frac{1}{(1 - \alpha g)^{K-1}}\right\}$$

The sum total of the wall flow quantity at this time $$\sum^{n} Qw$$

is set according to the above expression (3) as follows:

$$\sum^{n} Qw = \alpha w\,(1 - \alpha g)^{K+1} \cdot Qout \times \left\{\frac{1}{\alpha g} \cdot \frac{Qout(\phi)}{Qout} + \frac{1}{1 - \alpha g} + \ldots + \frac{1}{(1 - \alpha g)^{K-1}}\right\}$$

Now if the same procedure would be applied to the (K+1)-th time, the following are formulated:

$$Qout - Qin(K + 1) = Qout \cdot \alpha w(1 - \alpha g) - \alpha w \cdot \alpha g\,(1 - \alpha g)^K Qout \times \left\{\frac{1 - \alpha g}{\alpha g} \cdot \frac{Qout(\phi)}{Qout} + 1 + \frac{1}{1 - 1\alpha g} + \ldots + \frac{1}{(1 - \alpha g)K - 1}\right\}$$

Therefore, Qin(k+1)−Qin(k−1)=αg·αw(1−αg)K-{Qout−Qout(ϕ)}

Also, Qin(K)−Qin(K−1)=αg·αw(1−αg)$^{K-1}$-{Qout−Qout(ϕ)}

From these formulae the following expressions to find the evaporation ratio $\alpha g$ and the adhesion ratio $\alpha w$ are derived:

$$\alpha g = 1 - \frac{Qin[K+1] - Qin[K]}{Qin[K] - Qin[K-1]}$$

$$\alpha w = \frac{Qin[K] - Qin\{K-1]}{\alpha g(1-\alpha g)^{K-1} \cdot \{Qout - Qout(\phi)\}}$$

Accordingly, it is possible to find the evaporation ratio $\alpha g$ and the adhesion ratio $\alpha w$ respectively by using changes in the injected quantity Qout and the fuel quantity sucked into the cylinders Qin which may be forecast by the air-fuel ratio feedback correction coefficient LMD, after the fuel injection quantity Ti has been corrected at the time of steady operation until both Qout and Qin become the same, as shown in the flow chart of FIG. 5 described above.

The present embodiment has been described herein with regard to a fuel supply control system where the basic fuel injection quantity Tp is determined according to the intake air flow rate Q. It is to be understood, however, that the invention is not limited to the particular embodiment. The basic fuel injection quantity Tp also can be determined based on a detected intake pressure PB, and parameters of different operational conditions which decide the basic fuel injection quantity Tp are not limited to the intake air flow rate Q.

What is claimed is:

1. A wall flow learning method for a fuel supply control system for an internal combustion engine, said fuel supply control system determining an air-fuel ratio feedback correction coefficient to correct a fuel supply quantity corresponding to an air quantity sucked into said internal combustion engine so that an air-fuel ratio detected through an exhaust emission component concentration of said engine approaches a target air-fuel ratio while computing said fuel supply quantity, comprising the steps of;

correcting, in a compulsory, step-by-step manner, said fuel supply quantity in a steady operating condition of the said engine;

forecasting changes in said fuel supply quantity sucked into cylinders of said engine after said correcting step on the basis of changes in said air-fuel ratio feedback correction coefficient; and learning parameters for determining a wall flow quantity of fuel which adheres to an intake path wall surface of said engine based on forecast changes in said fuel quantity sucked into said cylinders.

2. A wall flow learning method for a fuel supply control system of an internal combustion engine according to claim 1, further comprising the step of:

updating said parameters learned in said learning step separately in operational regions classified into a plurality of partitions in compliance with different operating conditions.

3. A wall flow learning method for a fuel supply control system of an internal combustion engine according to claim 1, wherein:

said parameters, which are learned in said learning step, comprise an adhesion ratio of fuel supplied to said intake path wall surface and an evaporation ratio of the fuel evaporating from said wall flow quantity of fuel adhering to said intake path wall surface.

4. A wall flow learning method for a fuel supply control system of an internal combustion engine as described in claim 1, further comprising the steps of:

determining a correcting fuel quantity corresponding to changes in said wall quantity of fuel in transitional operation of said engine based on said parameters learned in said learning step which determine said wall flow quantity of fuel adhering to said intake patñ wall surface, and correcting said fuel supply quantity in transitional operation based on said correcting fuel quantity.

5. A wall flow learning device in a fuel supply control system of an internal combustion engine, said fuel supply control system comprising operational condition detecting means for detecting operational conditions of said internal combustion engine, fuel supply quantity computing means for computing a fuel supply quantity to be supplied on the basis of said operational conditions of said engine as detected, air-fuel ratio detecting means for detecting an air-fuel ratio of an air-fuel mixture sucked into said engine using an exhaust emission component concentration, feedback control means for setting an air-fuel ratio feedback correction coefficient to correct said fuel supply quantity so that said air-fuel ratio detected by said air-fuel ratio detecting means approaches a target air-fuel ratio, and fuel supply control means for controlling fuel supply into said engine from a fuel supply in compliance with said fuel supply quantity, said device comprising:

steady operation detecting means for detecting a steady operating condition of said engine;

fuel correcting means for correcting in a compulsory, step-by-step manner said fuel supply quantity when a steady operating condition of said engine is detected by said steady operation detecting means;

forecasting means for estimating changes in an intake fuel quantity sucked into cylinders of said engine after correction of said fuel supply quantity by said fuel correcting means based on changes in said air-fuel ratio feedback correction coefficient; and wall flow quantity learning means for learning parameters for determining a wall flow quantity of fuel adhering to an intake path wall surface based on a change in said intake fuel quantity forecast by said forecasting means.

6. A wall flow learning device in a fuel supply control system of an internal combustion engine according to claim 5, further comprising:

storing means for updating said parameters, which are learned by said wall flow quantity learning means and which determine said wall flow quantity of fuel, separately in operational regions classified into various partitions according to different operational conditions.

7. A wall flow learning device in a fuel supply control system of an internal combustion engine according to claim 5, wherein:

said parameters, which are learned by said wall flow quantity learning means, comprise an adhesion ratio of fuel supplied to said intake path wall surface and an evaporation ratio of fuel which evaporates from said wall flow quantity of fuel adhering to said intake path wall surface.

8. A wall flow learning device in a fuel supply control system of an internal combustion engine according to claim 5, further comprising:

correcting fuel quantity setting means for determining a correcting fuel quantity corresponding to changes in said wall flow quantity of fuel in transitional operation of said engine on the basis of parameters which are learned by said wall flow quantity learning means; and fuel correcting means for correcting and determining said fuel supply quantity in transitional operation on the basis of said correcting fuel quantity determined by said correcting fuel quantity setting means.

* * * * *